US006358016B1

(12) United States Patent
Hidaka et al.

(10) Patent No.: US 6,358,016 B1
(45) Date of Patent: Mar. 19, 2002

(54) DISPLACEMENT CONTROL DEVICE AND DISPLACEMENT CONTROL METHOD FOR VARIABLE DISPLACEMENT COMPRESSOR

(75) Inventors: Shigeyuki Hidaka; Masanori Sonobe; Ken Suitou; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/616,833

(22) Filed: Jul. 14, 2000

(30) Foreign Application Priority Data

Jul. 23, 1999 (JP) ..... 11-209357

(51) Int. Cl.[7] ..... F04B 1/29
(52) U.S. Cl. ..... 417/222.2; 62/228.5
(58) Field of Search ..... 62/228.5; 417/222.2, 417/269, 270, 271

(56) References Cited

U.S. PATENT DOCUMENTS 4,796,438 A * 1/1989 Sato ..... 62/228.5
4,848,101 A 7/1989 Suzuki ..... 62/228.5
4,862,700 A * 9/1989 Suzuki ..... 62/228.5
4,894,999 A * 1/1990 Kaiju et al. ..... 62/228.5
5,022,232 A * 6/1991 Sakamoto et al. ..... 62/228.5
5,823,000 A * 10/1998 Takai ..... 417/222.2
6,102,668 A * 8/2000 Kawaguchi et al. ..... 417/222.2
6,224,348 B1 * 5/2001 Fukanuma et al. ..... 417/222.2
6,244,159 B1 * 6/2001 Kimura et al. ..... 417/222.2

FOREIGN PATENT DOCUMENTS

EP 0 814 262 A2 12/1997

* cited by examiner

*Primary Examiner*—Michael Koczo
(74) *Attorney, Agent, or Firm*—Morgan & Finnegan, LLP

(57) ABSTRACT

A controller normally supplies current the magnitude of which corresponds to a required cooling performance of a refrigeration circuit to a displacement control valve. As a result the compressor displacement is adjusted in accordance with the required cooling performance (usual displacement control). When a vehicle is quickly accelerated, the controller temporarily eliminates the current value to the control valve to minimize the compressor displacement (displacement limiting control). When the control is switched from the displacement limiting control to the usual In displacement control, the controller changes the current value from zero to a target value, which corresponds to the required cooling performance, taking a predetermined restoration time. For an initial period of the restoration period, the current value is set greater than a corresponding value on a direct proportional line, which represents a constant rate of change from zero to the target value. As a result, the control is smoothly and quickly switched from the displacement limiting control to the usual displacement control.

20 Claims, 6 Drawing Sheets

DISPLACEMENT CONTROL DEVICE AND DISPLACEMENT CONTROL METHOD FOR VARIABLE DISPLACEMENT COMPRESSOR

BACKGROUND OF THE INVENTION

The present invention relates to a variable displacement compressor used for vehicle air conditioners, and more specifically, to a device and a method for controlling the displacement of a compressor.

In a general variable displacement compressor used for vehicle air conditioners, the inclination angle of a swash plate provided in a crank chamber changes in accordance with the pressure in the crank chamber. The crank chamber is connected to a suction chamber through a bleed passage and also to a discharge chamber through a supply passage. In the bleed passage is provided a displacement control valve. A controller containing a computer controls a control valve to adjust the amount of refrigerant gas that flows out into the suction chamber from the crank chamber through the bleed passage. As a result, the amount of the refrigerant gas which flows out of the crank chamber changes relative to the amount of refrigerant gas which is supplied to the crank chamber from the discharge chamber through the supply passage so that the pressure in the crank chamber is adjusted.

The control valve is provided with, for example, a valve body, a pressure sensing mechanism for operating the valve body in accordance with the pressure in the suction chamber (suction pressure), and an electromagnetic actuator, which urges the valve body with a force corresponding to the value of electric current supplied from the controller. The force of the electromagnetic actuator to urge the valve body reflects the target suction pressure. The controller adjusts the value of electric current supplied to the electromagnetic actuator to change the target suction pressure.

The controller increases the value of electric current supplied to the electromagnetic actuator to decrease the target suction pressure, and decreases the value of electric current supplied to the electromagnetic actuator to increase the target suction pressure. When electric current is not supplied to the electromagnetic actuator, the target suction pressure becomes a maximum value.

When a suction pressure exceeds the target suction pressure, the pressure sensing mechanism operates the valve body so as to increase the opening size of the bleed passage. Therefore, the flow rate of refrigerant gas from the crank chamber to the suction chamber is increased and the pressure in the crank chamber is then reduced. This increases the inclination angle of the swash plate so that displacement of the compressor increases. When the displacement of the compressor increases, the cooling performance of a refrigeration circuit incorporating the compressor increases and a suction pressure decreases so that it is converged to the target suction pressure.

When the suction pressure is lower than the target suction pressure, the pressure sensing mechanism operates the valve body to decrease the opening size of the bleed passage. Therefore, the flow rate of refrigerant gas from the crank chamber to the suction chamber decreases and the pressure in the crank chamber then increases. This decreases the inclination angle of the swash plate so that the displacement of the compressor decreases. When the displacement of the compressor decreases, the cooling performance of refrigeration circuit is reduced and a suction pressure increases so that it is converged to the target suction pressure.

Thus, the pressure sensing mechanism operates the valve body in accordance with the suction pressure in order to maintain the suction pressure at the target suction pressure.

The load on a vehicle engine increases under abrupt acceleration of the vehicle. Since the compressor is driven by the vehicle engine, if the engine load is great, the displacement of the compressor is temporarily minimized to reduce the engine load. Such displacement limiting control under abrupt acceleration of the vehicle will be described with reference to time charts of FIGS. 6(*a*) to 6(*c*).

As shown in FIG. 6(*a*), when a vehicle is abruptly to accelerated in a state where electric current of the predetermined value is supplied to an electromagnetic actuator of a displacement control valve, a controller sets the supplied current value for the electromagnetic actuator at zero to start the displacement limiting control. As a result, as shown in FIG. 6(*b*), the target suction pressure Pst is set at a maximum value Pmax. Then, the pressure sensing mechanism of the displacement control valve closes the bleed passage with the valve body to bring an actual suction pressure Psa near to the maximum value Pmax. Thus, the pressure in the crank chamber increases and the inclination angle of the swash plate becomes minimum, whereby the displacement of the compressor becomes minimum as shown in FIG. 6(*c*). In other words, the torque of the compressor becomes minimum so that the engine load is reduced.

When the target suction pressure Pst changes, some time is required for this change to be reflected in the change in the actual suction pressure Psa. Thus, when the target suction pressure Pst is rapidly changed to the maximum value Pmax as shown in FIG. 6(*b*), the actual suction pressure Psa gradually increases toward the maximum value Pmax.

As shown in FIG. 6(*a*), a displacement limiting control due to abrupt acceleration of a vehicle is completed after the lapse of the predetermined time S from its start. After that, the displacement limiting control is shifted to a usual displacement control in accordance with a cooling performance required for the refrigeration circuit. Specifically, the controller resumes the supply of current to the electromagnetic actuator after the lapse of the predetermined time S after setting the supplied current value for the electromagnetic actuator at zero. At this time, the controller obtains the target current value A3 according to the cooling performance required for the refrigeration circuit, and gradually increases the supplied current value for the electromagnetic actuator from zero to the target current value A3 for the predetermined time T (refer to the straight line H in FIG. 6(*a*)). According to this increase, the target suction pressure Pst gradually decreases from the it maximum value Pmax to the value P3 corresponding to the target current value A3 for the predetermined time T as shown in FIG. 6(*b*).

If the target suction pressure Pst rapidly decreases from the maximum value Pmax to the value P3, the actual suction pressure Psa, which is gradually increasing toward the maximum value Pmax, significantly exceeds the value P3 temporarily. Then, the pressure sensing mechanism of the displacement control valve causes the valve body to abruptly open the bleed passage to decrease the actual suction pressure Psa to the value P3. This leads to an abrupt decrease in the pressure in the crank chamber and rapidly increases the displacement of the compressor. As a result, the torque of the compressor rapidly increases and the engine load rapidly increases, whereby the vehicle drivability is deteriorated. To avoid such problems, the target suction pressure Pst gradually decreases from the maximum value Pmax to the value P3 for the predetermined time T.

As shown in FIG. 6(*b*), the actual suction pressure Psa is always lower than the target suction pressure Pst set at the maximum value Pmax through the predetermined time S when the displacement limiting control is being executed. Further, since the target suction pressure Pst gradually decreases at the completion of the displacement limiting control, the actual suction pressure Psa is still lower than the target suction pressure Pst between the completion of the displacement limiting control and the end of time Ta. When the time Ta elapses after the completion of the displacement limiting control, the actual suction pressure Psa substantially becomes equal to the target suction pressure Pst. After that, the actual suction pressure Psa is gradually reduced to the value P3 as the target suction pressure Pst is gradually reduced to the value P3.

When the actual suction pressure Psa is lower than the target suction pressure Pst, the pressure sensing mechanism of the displacement control valve causes the valve body to control the opening size of the bleed passage to increase the actual suction pressure Psa so as to bring it near the target suction pressure Pst. In other words, even if the displacement limiting control is completed, the pressure sensing mechanism does not execute an operation for decreasing the actual suction pressure Psa, that is an operation for increasing displacement of a compressor from the minimum state until the time Ta elapses after the completion.

In addition, the displacement control valve completely closes the bleed passage during execution of the displacement limiting control and the pressure in the crank chamber is excessively increased due to the high pressure gas supplied through the supply passage. Therefore, even if the control valve increases the opening size of the bleed passage to increase the displacement of the compressor after the lapse of the time Ta after the completion of the displacement limiting control, it takes much time to lower the pressure in the crank chamber to pressure by which the displacement of the compressor can shift from the minimum state to an increased state. Thus, as shown in FIG. 6(*c*), the displacement of the compressor shifts from the minimum state to the increased state with a delay of a considerably long time Tb after the completion of the displacement limiting control. That is, the displacement of the compressor is maintained in the minimum state for a time longer than the execution time S of the displacement limiting control. This means that a cooling performance of the refrigeration circuit unnecessarily decreases for a long time. As a result, the passenger compartment temperature further becomes higher than before execution of the displacement limiting control, which gives discomfort to passengers in the vehicle.

SUMMARY OF THE INVENTION

Accordingly, it is an objective of the present invention to provide a displacement control device and a displacement control method for a variable displacement compressor which smoothly and rapidly shift a displacement limiting control to a usual displacement control.

To attain the above-mentioned object, the present invention provides a displacement control device for a compressor that changes the displacement in accordance with the pressure in a control pressure chamber. The control device includes a control valve, a detector and a controller. The control valve controls the pressure in the control pressure chamber. The control valve has a valve body and an electromagnetic actuator for actuating the valve body. The actuator urges the valve body by a force the magnitude of which corresponds to the value of current supplied to the actuator. The detector detects external conditions that are necessary for controlling the compressor displacement. The controller controls the value of current supplied to the actuator. The controller selects a control mode to be executed from a usual displacement control and a displacement limiting control based on the detected external conditions. When the usual displacement control is selected, the controller sets the current value to a target value, which corresponds to the detected external conditions. When the displacement limiting control is selected, the controller temporarily sets the current value to a specific value to minimize the compressor displacement. When the control mode is switched from the displacement limiting control to the usual displacement control, the controller changes the current value from the specific value to the target value taking a predetermined restoration period. For at least part of the restoration period, the controller sets the current value to a value that is closer to the target value than a corresponding value on a direct proportional line, which represents a constant rate of change from the specific value to the target value.

The present invention also provides a method for controlling the displacement of a compressor that changes the displacement in accordance with the pressure in a control pressure chamber. The method includes: controlling the pressure in the control pressure chamber by a control valve, wherein the control valve has a valve body and an electromagnetic actuator for actuating the valve body, wherein the actuator urges the valve body by a force the magnitude of which corresponds to the value of current supplied to the actuator; detecting external conditions that are necessary for controlling the compressor displacement; selecting a control mode to be executed from a usual displacement control and a displacement limiting control based on the detected external conditions; setting the current value to a target value, which corresponds to the detected external conditions, when the usual displacement control is selected; temporarily setting the current value to a specific value to minimize the compressor displacement when the displacement limiting control is selected; and changing the current value from the specific value to the target value taking a predetermined restoration period when the control mode is switched from the displacement limiting control to the usual displacement control. For at least part of the restoration period, the current value is set to a value that is closer to the target value than a corresponding value on a direct proportional line, which represents a constant rate of change from the specific value to the target value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
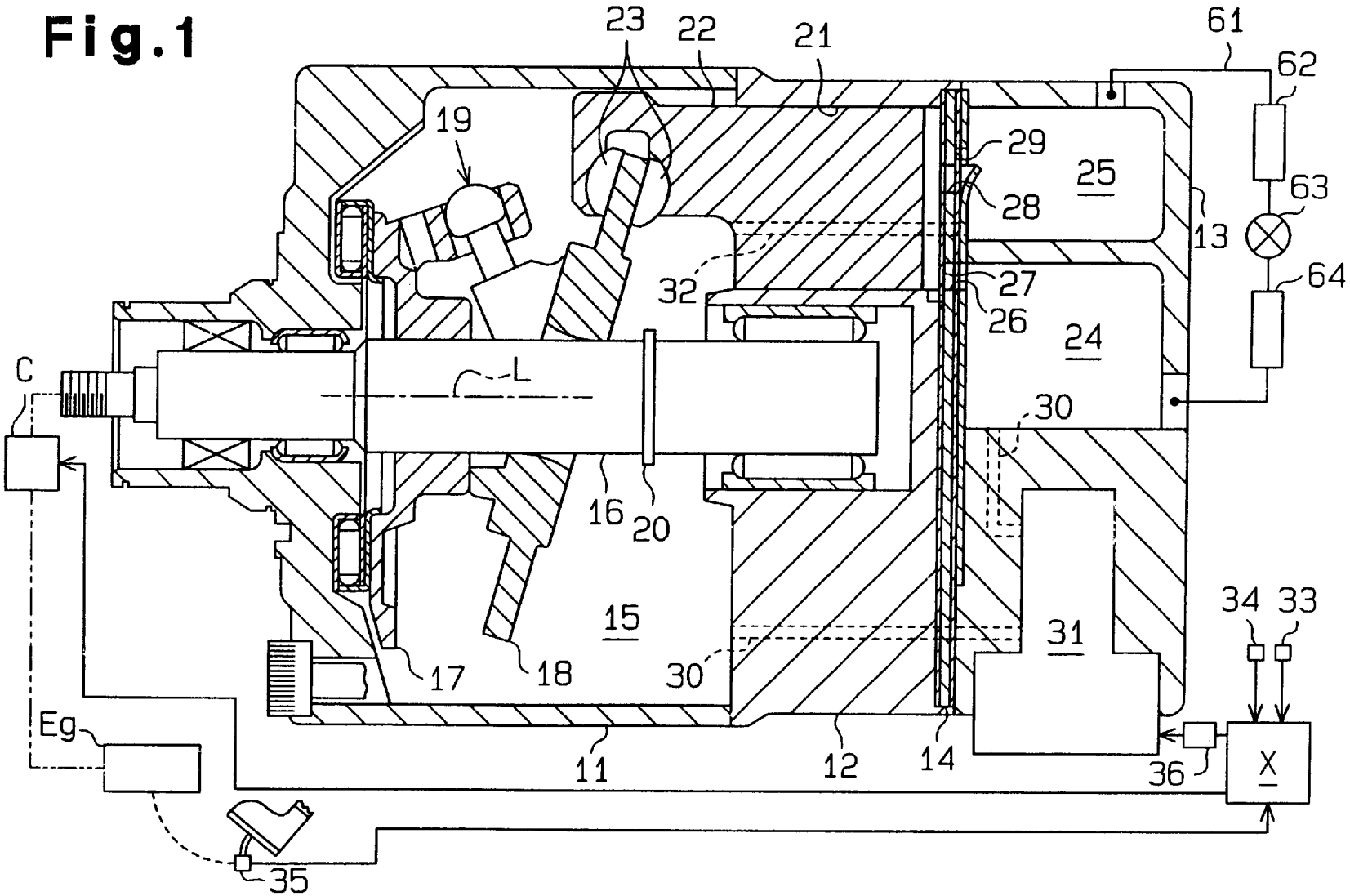
FIG. 1 is a cross-sectional view of a variable displacement compressor in one of the embodiments of the present invention.

One embodiment according to the present invention will be described with reference to FIG. 1 through FIG. 4(*c*). First, the structure of a variable displacement compressor will be described. As shown in FIG. 1, a front housing member 11 is joined by the front end of a cylinder block 12. A rear housing 13 is joined by the rear end of the cylinder block 12 through a valve plate assembly 14. A control pressure chamber, which is a crank chamber 15 in this embodiment, is defined by the front housing member 11 and the cylinder block 12.

A drive shaft 16 is rotatably supported by the front housing member 11 and the cylinder block 12 to extend through the crank chamber 15. The drive shaft 16 is connected to a vehicle engine Eg, which functions as an external driving force, through a clutch mechanism C such as an electromagnetic clutch. The clutch mechanism C selectively transmits the driving force of the engine Eg to the drive shaft 16.

A rotary support 17 is fixed to the drive shaft 16 in the crank chamber 15. A drive plate, which is a swash plate 18 in this embodiment, is supported on the drive shaft 16. The swash plate 18 slides along and inclines relative to the axis L. A hinge mechanism 19 is located between the rotary support 17 and the swash plate 18. The swash plate 18 is connected to the rotary support 17 through the hinge mechanism 19. The hinge mechanism 19 causes the swash plate 18 to rotate integrally with the rotary support 17. Further, the hinge mechanism 19 guides the sliding and the inclination of the swash plate 18 with respect to the drive shaft 16.

Figure 3:
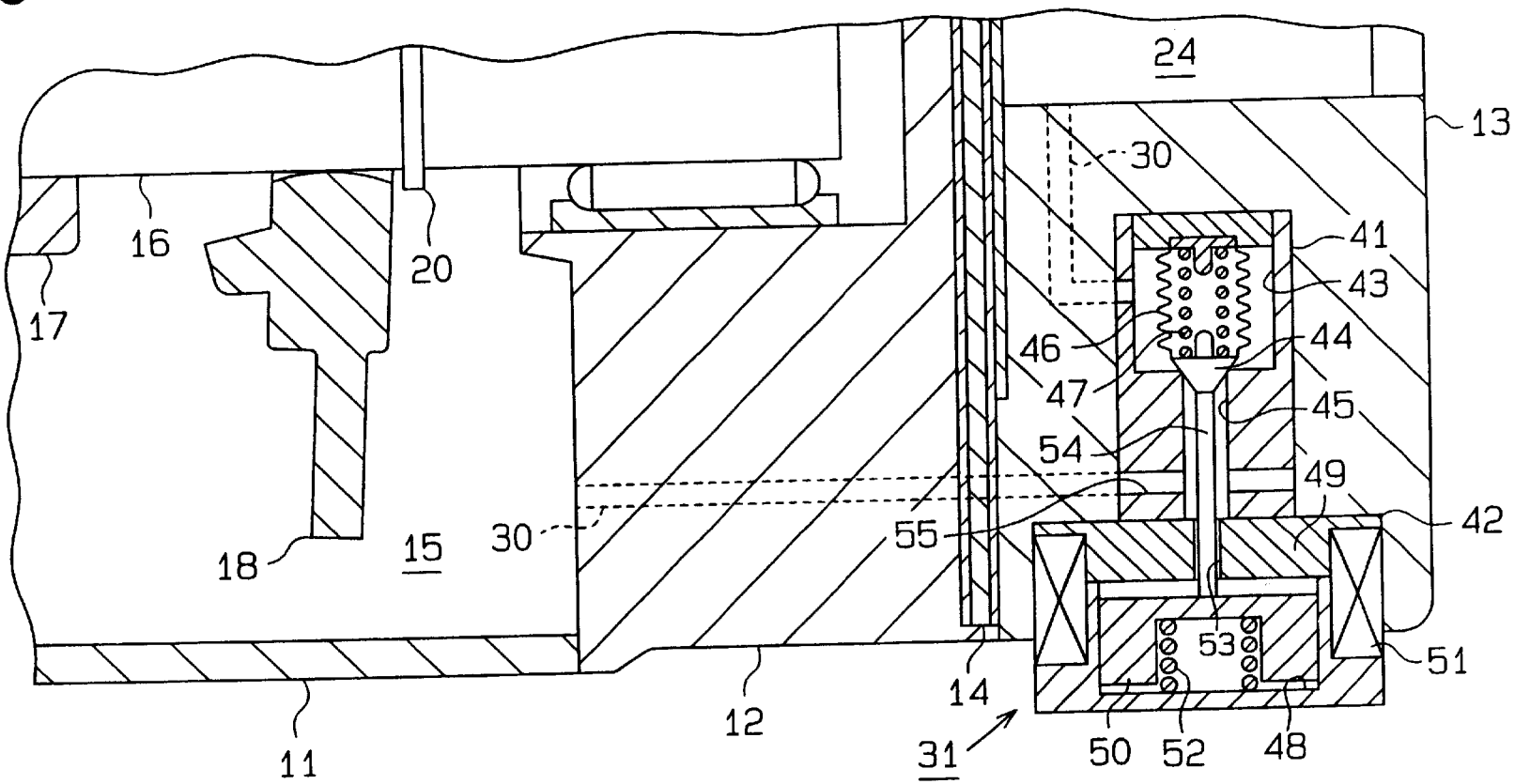
FIG. 3 is a partially enlarged cross-sectional view showing the compressor of FIG. 1 when it is being operated in the minimum displacement.

As the center portion of the swash plate 18 is moved toward the rotary shaft 17, the inclination angle of the swash By plate 18 increases. On the other hand, as the center portion of the swash plate 18 is moved toward the cylinder block 12, the inclination angle of the swash plate 18 decreases. A limit ring 20 is mounted on the drive shaft 16 between the swash plate 18 and the cylinder block 12. As shown in FIG. 1, when the swash plate 18 contacts the rotary support 17, the inclination angle of the swash plate 18 becomes maximum. As shown in FIG. 3, when the swash plate 18 contacts the limit ring 20 the inclination angle of the swash plate 18 becomes minimum.

Cylinder bores 21 (only one is shown in FIG. 1) extend through the cylinder block 12 to surround the drive shaft 16. A single-headed piston 22 is accommodated in each cylinder bore 21. Each piston 22 is coupled to the periphery of the swash plate 18 through a pair of shoes 23. The swash plate 18 converts rotation of the drive shaft 16 to reciprocation of each piston 22 in the corresponding cylinder bore 21.

A suction chamber 24, which is a suction pressure zone, and a discharge chamber 25, which is a discharge pressure zone, are formed in the rear housing member 13. A suction port 26, a suction valve flap 27, a discharge port 28 and a discharge valve flap 29 are formed in the valve plate assembly 14 to correspond to each of the cylinder bores 21.

When each piston 22 is moved from the top dead center position to the bottom dead center position, refrigerant gas is sucked to the corresponding cylinder bores 21 from the suction chamber 24 through the suction port 26 and the suction valve flap 27. When each piston 22 is moved from the bottom dead center position to the top dead center position, the refrigerant gas is compressed to a predetermined pressure in the corresponding cylinder bore 21 and is then discharged to the discharge chamber 25 through the discharge port 28 and the discharge valve flap 29. When the piston 22 compresses the refrigerant gas, a high pressure refrigerant gas escapes from the inside of the cylinder bore 21 to the crank chamber 15 through a slight gap between the piston 22 and the cylinder bore 21. Such gas is referred to as blowby gas.

An external refrigerant circuit 61 connects the suction chamber 24 to the discharge chamber 25. The external refrigerant circuit 61 includes a condenser 62, an expansion valve 63 and an evaporator 64. The compressor and the external refrigerant circuit 61 form a refrigeration circuit for a vehicle air-conditioner.

As shown in FIG. 1, a control passage, which is a bleed passage 30, connects the crank chamber 15 to the suction chamber 24. A displacement control valve 31 is accommodated in the rear housing 13 to regulate the bleed passage 30. A supply passage 32 connects the discharge chamber 25 to the crank chamber 15. The high pressure refrigerant gas in the discharge chamber 25 is supplied to the crank chamber 15 through the supply passage 32.

A temperature adjuster 33 for setting the target value of a passenger compartment temperature, a passenger compartment temperature sensor 34, a pedal position sensor 35, the clutch mechanism C and the control valve 31 are connected to a controller X. The pedal position sensor 35 detects a degree of depression of the vehicle gas pedal, that is the position of the gas pedal. The degree of pedal depression represents the load on the engine Eg. The controller X contains a computer. Further, the controller X is connected to the control valve 31 through a drive circuit 36. The temperature adjuster 33, the temperature sensor 34 and the pedal position sensor 35 form an external state detecting means or an external state detector.

Figure 2:
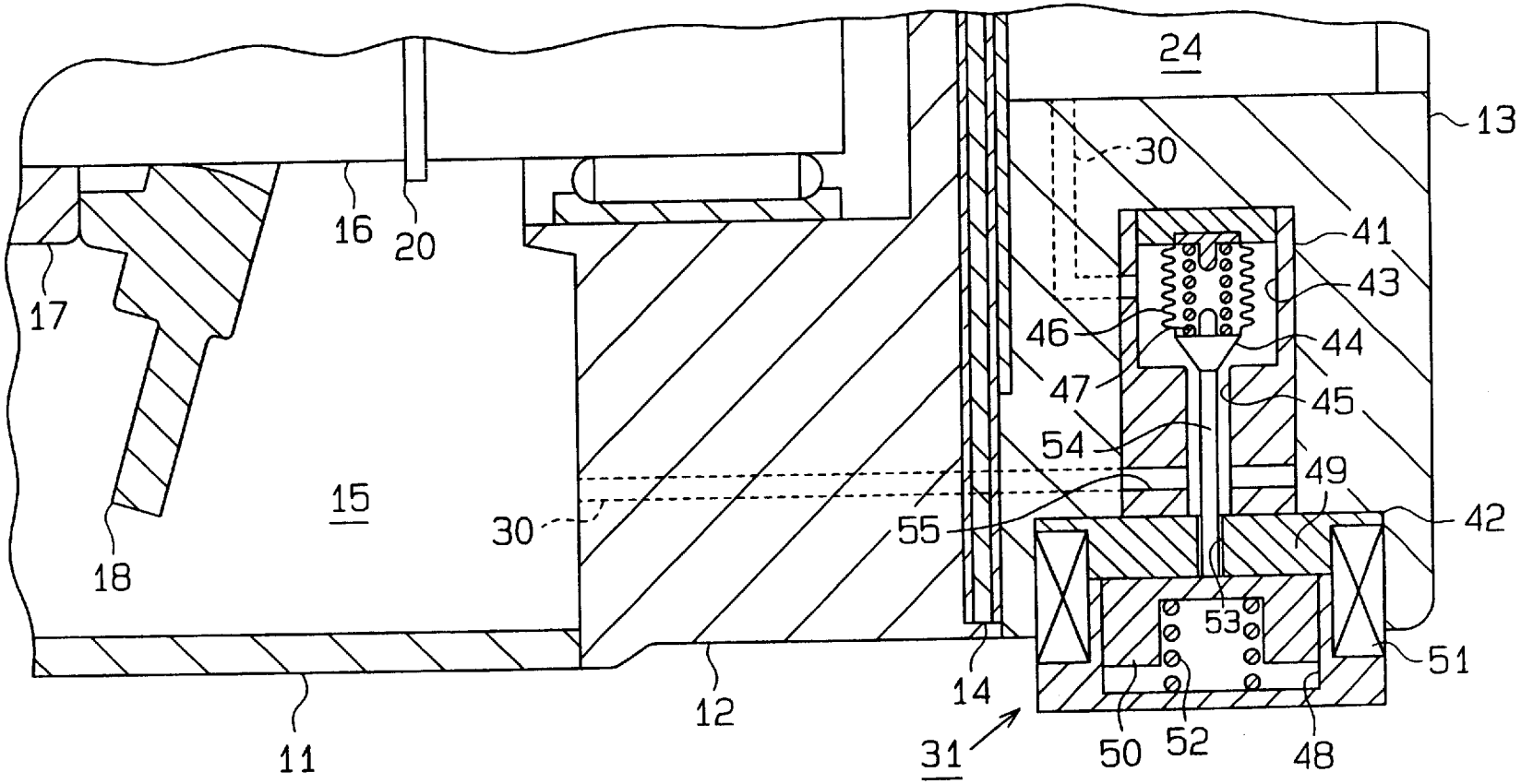
FIG. 2 is a partially enlarged cross-sectional view showing the compressor of FIG. 1 when it is being operated in the maximum displacement.

The control valve 31 will now be described. As shown in FIGS. 2 and 3, the control valve 31 has a valve housing 41 and a solenoid unit 42, which are coupled to each other. A valve chamber 43, which also serves as a pressure sensing chamber, is formed in the valve housing 41. A valve body 44 is located in the valve chamber 43. A valve hole 45 extends axially in the valve housing 41. The valve hole 45 opens in the valve chamber 43 to face the valve body 44. The valve chamber 43 is connected to the suction chamber 24 through the downstream portion of the bleed passage 30.

A pressure sensing member, which is a bellows 46 in this embodiment, is housed in the valve chamber 43. The top end of the bellows 46 is fixed to the ceiling wall of the valve chamber 43 and the lower end of the bellows 46 is connected to the valve body 44. A setting spring 47 is located in the bellows 46. The setting spring 47 sets the initial length of the bellows 46. The valve chamber 43, the bellows 46 and the setting spring 47 form a pressure sensing mechanism.

The solenoid unit 42, or the electromagnetic actuator, has a plunger chamber 48. To the upper opening of the plunger chamber 48 is fitted a fixed core 49. A plunger 50 is housed in the plunger chamber 48. A cylindrical coil 51 is located around the fixed core 49 and the plunger 50. The drive circuit 36 is connected to the coil 51. A follower spring 52 is located between the plunger 50 and the bottom wall of the plunger chamber 48 and urges the plunger 50 toward the fixed core 49.

A guide hole 53 extends through the fixed core 49 to be coaxial with the valve hole 45. A transmission rod 54 extends in the guide hole 53 and the valve hole 45. The proximal end of the transmission rod 54 is fixed to the plunger 50. The follower spring 52 urges the transmission rod 54 through the plunger 50 toward the valve body 44, which causes the distal end of the transmission rod 54 to contact the valve body 44. In other words, the plunger 50 and the valve body 44 are coupled to each other by the transmission rod 54. The valve body 44 is urged in a direction to open the valve hole 45 by the follower spring 52.

A port 55 is formed in the valve housing 41 between the valve chamber 43 and the plunger chamber 48. The valve hole 45 is connected to the crank chamber 15 through the port 55 and the upstream portion of the bleed passage 30. The valve chamber 43, the valve hole 45 and the port 55 form a part of the bleed passage 30.

Under operating conditions of the engine Eg, when an air-conditioner operating switch (not shown) is turned on and the passenger compartment temperature detected by the temperature sensor 34 exceeds the target temperature set by the temperature adjuster 33, the controller X actuates the clutch mechanism C to drive the compressor.

The controller X normally determines a cooling performance required for the refrigeration circuit based on signals from the temperature adjuster 33 and the temperature sensor 34. Accordingly, the controller X determines the value of current supplied to the coil 51. The controller X supplies the current of the determined value to the coil 51 through the drive circuit 36. Then, between the fixed core 49 and the plunger 50 is generated electromagnetic attraction force according to the supplied current value. The magnitude of the attraction force represents the target value of the pressure in the suction chamber 24 (target suction pressure) and urges the valve body 44 through the transmission rod in a direction increasing the opening size of the valve hole 45.

On the other hand, the bellows 46 of the control valve 31 expands and contracts in accordance with the pressure in the valve chamber 43. In other words, the bellows 46 applies a force the magnitude of which corresponds to the pressure in the valve chamber 43 to the valve body 44. In this case the pressure (suction pressure) in the suction chamber 24 is introduced into the valve chamber 43 through the downstream portion of the bleed passage 30. Therefore, the valve chamber 43 is exposed to the suction pressure.

The suction pressure in the valve chamber 43 urges the valve body 44 toward the valve hole 45. Further, the valve body 44 is exposed to the pressure (crank pressure) in the crank chamber 15 through the upstream portion of the bleed passage 30, the port 55 and the valve hole 45. The crank. pressure urges the valve body, 44 away from the valve hole 45. The crank pressure is than the suction pressure. Therefore, the valve body 44 is urged away from the valve hole 45 by the force corresponding to the difference between the crank pressure and the suction pressure.

Each of the forces that act on the valve body 44 determines the position of the valve body 44 with respect to the valve hole 45, that is the degree of the opening of the valve hole 45.

The higher the passenger compartment temperature is with respect to the target temperature, in other words, the greater the cooling performance required for the refrigeration circuit is, the controller X makes the supplied current value for the coil 51 greater. Accordingly, the attraction force between the fixed core 49 and the plunger 50 becomes stronger and the force which urges the valve body 44 away from the valve hole 45 increases. This means that the target suction pressure is set at a lower value. The bellows 46 causes the valve body 44 to adjust the opening size of the valve hole 45 such that the actual suction pressure is maintained to the lower target suction pressure. That is, the greatr the supplied current value to the coil 51 is, the control valve 31 adjusts the displacement of the compressor to maintain the lower suction pressure.

If the actual suction pressure is higher than the target suction pressure, the bellows 46 causes the valve body 44 to increase the opening size of the valve hole 45. Then, the flow rate of the refrigerant gas discharged to the suction chamber 24 from the crank chamber 15 through the bleed passage 30 increases, and the pressure in the crank chamber 15 decreases. Thus, the inclination angle of the swash plate 18 increases and the displacement of the compressor increases. The increase in the compressor displacement increases the cooling performance of the refrigeration circuit and decreases the actual suction pressure so that the actual suction pressure is converged to the target suction pressure.

When the valve body 44 fully opens the valve hole 45, a great amount of the refrigerant gas is discharged from the crank chamber 15 to the suction chamber 24, whereby the pressure in the crank chamber 15 significantly decreases. Accordingly, the inclination angle of the swash plate 18 becomes maximum and the displacement of the compressor becomes maximum (see FIG. 2).

The smaller the difference between the passenger compartment temperature and the target temperature is, in other words, the smaller the cooling performance required for the refrigeration circuit is, the controller X makes the supplied current value for the coil 51 smaller. Accordingly, the attraction force between the fixed core 49 and the plunger 50 becomes weaker and the force which urges the valve body 44 in a direction distant from the valve hole 45 decreases. This means that the target suction pressure is set at a higher value. The bellows 46 causes the valve body 44 to adjust the opening size of the valve hole 45 so that the actual suction pressure is maintained at the higher target suction pressure. That is, the smaller the supplied current value for the coil 51 is, the control valve 31 adjusts the displacement of the compressor to maintain the higher suction pressure.

If the actual suction pressure is lower than the target suction pressure, the bellows 46 causes the valve body 44 to decrease the opening size of the valve hole 45. Then, the flow rate of the refrigerant gas discharged to the suction chamber 24 from the crank chamber 15 through the bleed passage 30 decreases, and the pressure in the crank chamber 15 increases. Thus, the inclination angle of the swash plate 18 becomes smaller and the displacement of the compressor decreases. The decrease in the compressor displacement decreases the cooling performance of the refrigeration circuit and increases an actual suction pressure so that the actual suction pressure may be converged to the target suction pressure.

When the valve body 44 fully closes the valve hole 45, no refrigerant gas is discharged from the crank chamber 15 to the suction chamber 24, which significantly increases the pressure in the crank chamber 15. Accordingly, the inclination angle of the swash plate 18 becomes minimum and the displacement of the compressor becomes minimum (see FIG. 3).

As described above, the displacement of the compressor is usually adjusted according to the cooling performance required for the refrigeration circuit. However, when the load on the engine Eg abruptly increases under an abrupt acceleration of the vehicle, a displacement limiting control for reducing the engine load is performed. The displacement limiting control temporarily minimizes the displacement of the compressor.

To reduce the engine load under abrupt acceleration of a vehicle, a clutch mechanism C may be turned off and the compressor may be temporarily separated from the engine Eg. However, to ensure the minimum cooling performance even under abrupt acceleration of the vehicle and to avoid shock that accompanies the turning on/off of the clutch mechanism, turning the clutch mechanism C off temporarily is not preferable.

Figure 4A:
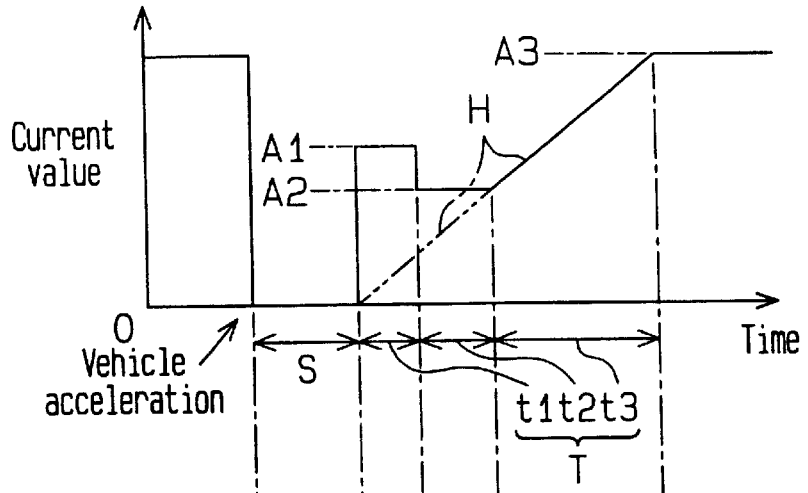
FIGS. 4(*a*) to 4(*c*) are time charts showing operations during the displacement limiting control in the compressor of FIG. 1.
Figure 4B:
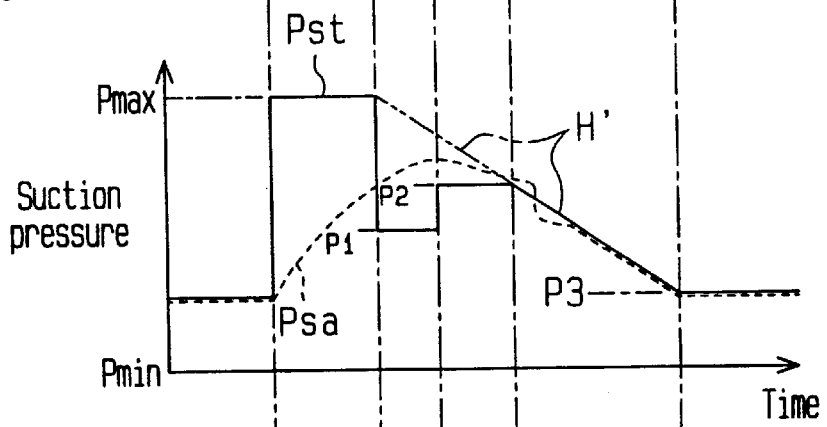
Figure 4C:
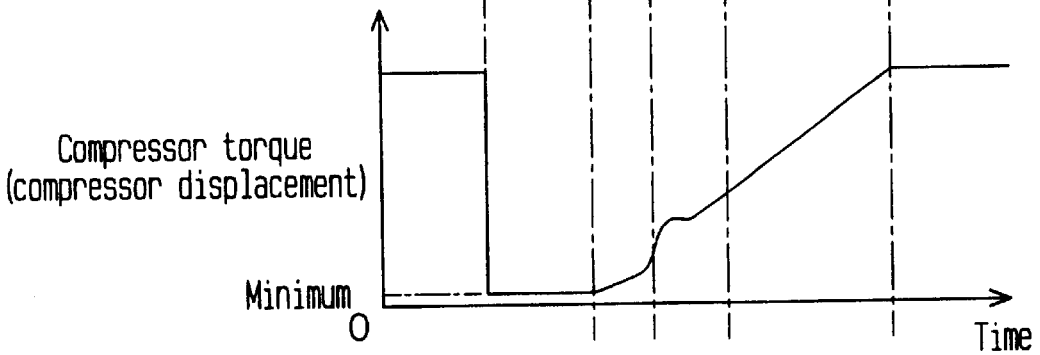

Next, a displacement limiting control under abrupt acceleration of the vehicle will be described with reference to time charts of FIG. 4(*a*) to FIG. 4(*c*). As shown in FIG. 4(*a*), when the degree of pedal depression detected by the pedal position sensor 35 reaches the predetermined value or greater under a state where the predetermined value of current was supplied to the coil 51 of the control valve 31, the controller X determines the start of abrupt acceleration of a vehicle and starts the displacement limiting control. That is, the controller X commands the drive circuit 36 to make the supplied current value for the coil 51 change from a value corresponding to the required cooling performance to a specific value, or zero.

As a result, as shown in FIG. 4(*b*), the target suction pressure Pst changes over from the value corresponding to the required cooling performance to the maximum value Pmax. Then, the bellows 46 causes the valve body 44 to close the valve hole 45 so that an actual suction pressure Psa approximates the maximum value Pmax. Therefore, the pressure in the crank chamber 15 increases and the displacement of the compressor becomes minimum as shown in FIG. 4(*c*). In other words, the torque of the compressor becomes minimum, whereby the engine load is reduced. Thus, the vehicle is faborably abruptly accelerated.

As shown in FIG. 4(*a*), after the predetermined time S (for-example one second) has passed from the start of the displacement limiting control, the controller X completes the displacement limiting control and shifts the displacement limiting control to a usual displacement control according to the cooling performance required for the refrigeration circuit. Specifically, the controller X increases the supplied current value for the coil 51 from zero to the target current value A3 according to the required cooling performance for the predetermined time T. Accordingly, as shown in FIG. 4(*b*), the target suction pressure Pst decreases from the maximum value Pmax to a value P3 corresponding to the target current value A3 for the predetermined time T.

The oblique line H shown by the two dotted and dash lines and the solid line in FIG. 4(*a*) is a direct proportional increase line showing that the supplied current value for the coil 51 increases from zero to the target current value A3 at a constant rate. During a period (the first term t1 and the second term t2) in the predetermined time T, the values of current supplied to the coil 51 are set at values A1 and A2, which are greatr than values in the corresponding period on the direct proportional increase line H.

Specifically, at the same time when the displacement limiting control has been completed, the supplied current value for the coil 51 is abruptly increased to the value A1 from zero and the current value A1 is maintained only during the first term t1. Subsequently, the supplied current value is abruptly lowered to the value A2, which is lower than the value A1, and the current value A2 is maintained only during the second term t2. The second term t2 is completed when the is current value A2 agrees with a value on the direct proportional increase line H. In the subsequent third term t3, the supplied current value is gradually increased to the target current value A3 in accordance with the direct proportional increase line H.

An oblique line H' shown by two dotted and dash lines and a solid line in FIG. 4(*b*) is a line corresponding to the direct proportional increase line H in FIG. 4(*a*), which is a direct proportional decrease line showing that the target suction pressure Pst decreases from the maximum value Pmax to a value P3 at a constant rate. During the first term t1 and the second term t2, the target suction pressure Pst is set at values P1 and P2. The values P1 and P2 correspond to the current values A1 and A2 and lower than values in the corresponding period on the direct proportional decrease line H'.

At the completion of the displacement limiting control, the current value A1 in the first term t1 sets the target suction pressure Pst to the value P1, which is significantly lower than the actual suction pressure Psa. Therefore, as shown in FIG. 4(*b*), the actual suction pressure Psa is significantly higher than the value P1 of the target suction pressure Pst immediately after the completion of the displacement limiting control. Then, the bellows 46 causes the valve body 44 to widely open the valve hole 45 to decrease the actual suction pressure Psa to the value P1 immediately after the completion of the displacement limiting control. As a result, the pressure in the crank chamber 15 abruptly decreases so that the displacement of the compressor changes from the minimum state to an increased state with no substantial delay after the completion of the displacement limiting control, as shown in FIG. 4(*c*).

As shown in FIG. 4(*b*), in the second term t2, the target suction pressure Pst is set at a value P2, which is higher than the value P1 and lower than the actual suction pressure Psa, when the supplied current value is changed to a value A2. In other words, in the second term t2, the target suction pressure Pst further increases to near the actual suction pressure Psa as compared with the case in the first term t1. Accordingly, the bellows 46 causes the valve body 44 to operate such that the opening size of the valve hole 45 is further reduced as compared with the case in the first term t1. As a result, an abrupt and excessive decrease in the pressure in the crank chamber 15 is prevented, which prevents an abrupt increase in the displacement and the torque of the compressor as shown in FIG. 4(*c*).

As shown in FIG. 4(*b*), the actual suction pressure Psa is substantially converged to the value P2 of the target suction pressure Pst at the completion of the second term t2. In the subsequent third term t3, the target suction pressure Pst gradually decreases to the value P3 in accordance with the direct proportional decrease line H' as the supplied current value gradually increases in accordance with the direct proportional increase line H. The actual suction pressure Psa lowers in accordance with a gradual decrease of the target suction pressure Pst without deviating from the line showing the decrease in the target suction pressure Pst. Therefore, no abrupt change in the pressure in the crank chamber 15 occurs and the displacement and the torque of the compressor smoothly increase.

The present embodiment described above has the following advantages.

In returning to the usual displacement control from the displacement limiting control, the supplied current value for the coil 51 is changed to the target current value A3 according to the required cooling performance from zero for the predetermined time T. Thus, the displacement of the compressor, in other words, the torque of the compressor gradually increases and an abrupt increase in the engine load is prevented, which improves the vehicle drivability.

In terms t1 and t2 just after the completion of the displacement limiting control, the supplied current values for the coil 51 are set at values A1 and A2, which are nearer to the target current value A3 than values in the corresponding period on the direct proportional increase line H shown in FIG. 4(*a*). As a result, the pressure in the crank chamber 15 rapidly decreases and the displacement of the compressor changes from the minimum state to an increased state without substantial delay from the completion of the displacement limiting control. Thus, the compressor is operated at the minimum displacement only for a term substantially equal to the execution time S for the displacement limiting control, in other words, only for a necessary minimum time. Thus, the displacement limiting control does not significantly lower the cooling performance of the refrigeration circuit, and the passengers are not disturbed.

The supplied current value A2 in the second term t2 subsequent to the first term t1 is made smaller than the supplied current value A1 in the first term t1. As a result, the displacement of the compressor immediately increases after the completion of the displacement limiting control. However, an abrupt increase in displacement, which is accompanied with shock, is prevented. Therefore, the displacement limiting control is smoothly and rapidly changed to a usual displacement control.

The control valve 31 in the present embodiment has the solenoid unit 42 and the bellows 46. The solenoid unit 42 sets the target suction pressure, which is used as the reference of operations of the bellows 46, according to the supplied current value. The bellows 46 actuates the valve body 44 according to the actual suction pressure. As described in the background section, a change of the displacement of a compressor from the minimum state to an increased state delays after the displacement limiting control is completed. This problem is particularly likely to occur in the control valve 31, which has the above described structure. Therefore, the application of the control system of the present embodiment to the control valve 31 is the most effective in overcoming the problem.

It should be apparent to those skilled in the art that the present invention may be embodied in many other specific forms without departing from the spirit or scope of the invention. Particularly, it should be understood that the invention may be embodied in the following forms.

Figure 5:
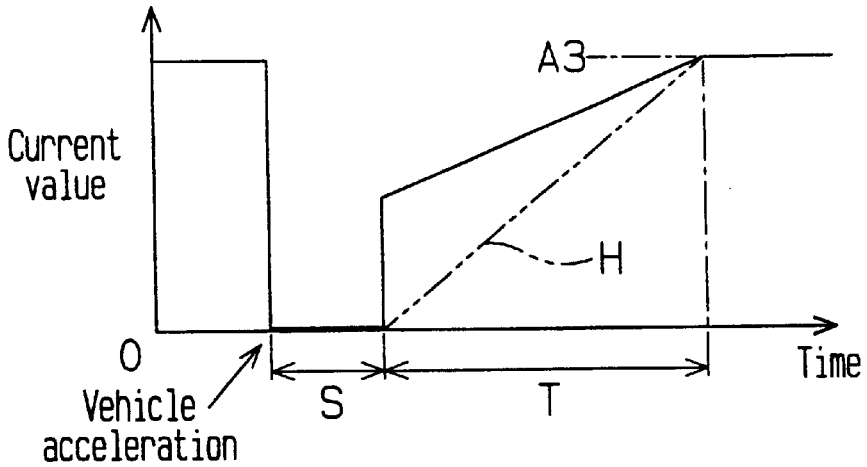
FIG. 5 is a time chart showing operations during a displacement limiting control in another embodiment.
Figure 6A:
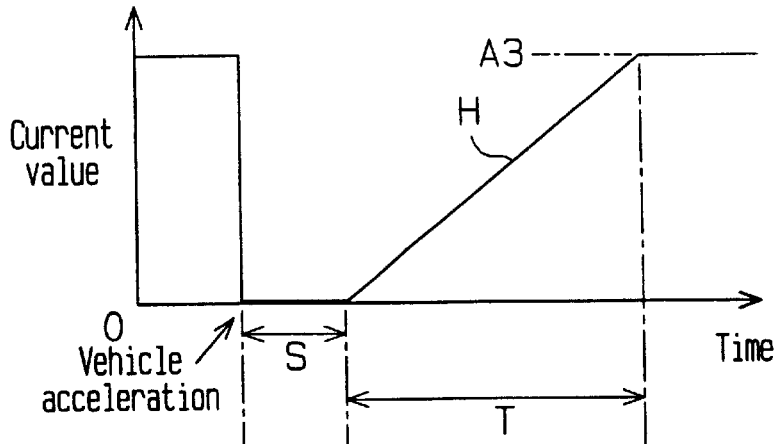
Fig.6(a) (Prior Art)
FIGS. 6(*a*) to 6(*c*) are time charts showing operations during a displacement limiting control in a conventional compressor.
Figure 6B:
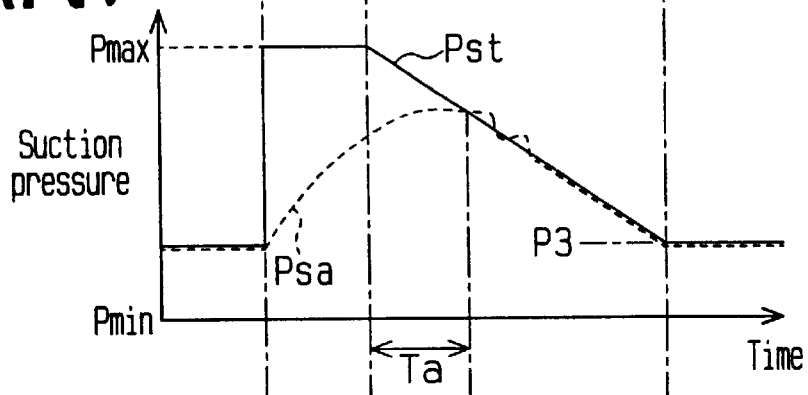
Fig.6(b) (Prior Art)
Figure 6C:
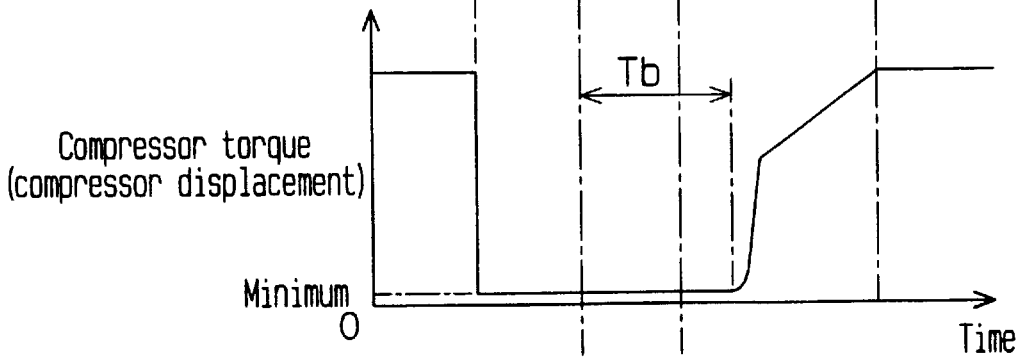
Fig.6(c) (Prior Art)

A current supply system for the coil 51 in the predetermined time T is not limited to the system shown in FIG. 4(*a*). For example, as shown in FIG. 5, a supplied current value for the coil 51 may be immediately increased to the predetermined value (which is lower than the target current value A3) from zero immediately after the completion of the displacement limiting control and the value may be gradually increased to the target current value A3 from the predetermined value at a constant ratio. In this case, the supplied current values for the coil 51 become greater than values in the corresponding period on the direct proportional increase line H in the entire predetermined time T.

Further, the supplied current values for the coil 51 may be maintained between the first term t1 and the second term t2. Specifically, the supplied current value may be increased to the predetermined value (which is lower than the target current value A3) from zero after the completion of the displacement limiting control and the predetermined value may be then maintained until the required value agrees with a value on the direct proportional increase line H.

The periods of time in which the supplied current values for the coil 51 are made greater than the values on the direct proportional increase line H are not limited to the terms t1 and t2 shown in FIG. 4(*a*). For example, the supplied current values may be greater than the values on the line H during a period after some time from the completion of the displacement limiting control.

The control valve to which the present invention is applied is not limited to that shown in FIGS. 2 and 3. For example, unlike the control valve 31 of FIGS. 2 and 3, the present invention may be applied to a control valve in which the target suction pressure is raised as the supplied current value to the coil is increased. As a pressure sensing member, a diaphragm may be used in place of the bellows 46. Further, the pressure sensing member may be omitted, and the valve body 44 may be operated only by the solenoid unit 42. Further, the present invention may be applied to a control valve located in the supply passage 32.

The displacement limiting control may be started when the rate of change per unit time for a degree of pedal depression detected by the pedal position sensor 35 becomes the predetermined value or more.

Therefore, the present examples and embodiments are to be considered as illustrative and not restrictive and the invention is not to be limited to the details given herein, but may be modified within the scope and equivalence of the appended claims.

What is claimed is:

1. A displacement control device for a compressor that changes the displacement in accordance with the pressure in a control pressure chamber, comprising:

a control valve for controlling the pressure in the control pressure chamber, the control valve having a valve body and an electromagnetic actuator for actuating the valve body, wherein the actuator urges the valve body by a force the magnitude of which corresponds to the value of current supplied to the actuator;

a detector for detecting external conditions that are necessary for controlling the compressor displacement; and a controller for controlling the value of current supplied to the actuator, wherein the controller selects a control mode to be executed from a usual displacement control and a displacement limiting control based on the detected external conditions, wherein, when the usual displacement control is selected, the controller sets the current value to a target value, which corresponds to the detected external conditions, wherein, when the displacement limiting control is selected, the controller temporarily sets the current value to a specific value to minimize the compressor displacement, wherein, when the control mode is switched from the displacement limiting control to the usual displacement control, the controller changes the current value from the specific value to the target value taking a predetermined restoration period, and wherein, for at least part of the restoration period, the controller sets the current value to a value that is closer to the target value than a corresponding value on a direct proportional line, which represents a constant rate of change from the specific value to the target value.

2. The control device according to claim 1, wherein the control valve includes a pressure sensing mechanism, and wherein the pressure sensing mechanism moves the valve body in accordance with a suction pressure, which is the pressure of refrigerant gas drawn into the compressor.

3. The control device according to claim 2, wherein the pressure sensing mechanism moves the valve body such that the suction pressure is maintained at a target suction pressure, and wherein the target suction pressure is determined by the current value supplied to the electromagnetic actuator.

4. The control device according to claim 1, wherein the part of the restoration period includes an initial period of the restoration period.

5. The control device according to claim 4, wherein, at substantially the same time as the displacement limiting control is finished, the controller instantaneously changes the current value to a first value, the first value being between the specific value and the target value.

6. The control device according to claim 5, wherein the controller maintains the current value to the first value for a predetermine first period after the displacement limiting control is finished, wherein, for a subsequent second period, the controller maintains the current value to a second value, which is closer to the specific value than the first value, and then gradually changes the current value from the second value to the target value along the direct proportional line.

7. The control device according to claim 5, wherein, during the restoration period, the controller gradually changes the current value at a constant rate from the first value to the target value.

8. The control device according to claim 1, wherein the specific value is zero.

9. The control device according to claim 1, wherein the compressor is installed in a refrigeration circuit and is driven by an external drive source, wherein the detector includes a first detector for detecting an external condition that represents the load on the external drive source and a second detector for detecting an external condition that represents a required cooling performance of the refrigeration circuit, wherein the controller selects the control mode to be executed based on the external condition detected by the first detector, and wherein, when the usual displacement control is selected, the controller determines the current value in accordance with the external condition detected by the second detector.

10. The control device according to claim 9, wherein the external drive source is a vehicle engine, and the first detector detects a depression degree of an acceleration pedal of the vehicle.

11. The control device according to claim 9, wherein the compressor is installed in a vehicle, wherein the second detector includes a temperature sensor for detecting the temperature of a passenger compartment and a temperature adjuster for setting a target value of the passenger compartment temperature, wherein, when the usual displacement control is selected, the controller determines the current value in accordance with the difference between the detected compartment temperature and the set target temperature.

12. A displacement control device for a compressor installed in a refrigeration circuit, wherein the compressor is driven by an external drive source and changes the displacement in accordance with the pressure in a control pressure chamber, the control device comprising:

a control valve for controlling the pressure in the control pressure chamber, the control valve including:

a valve body;

a pressure sensing mechanism, wherein the pressure sensing mechanism moves the valve body in accordance with a suction pressure, which is the pressure of refrigerant gas drawn into the compressor, such that the suction pressure is maintained at a predetermined target suction pressure; and an electromagnetic actuator for urging the valve body by a force the magnitude of which corresponds to the value of current supplied to the actuator, wherein the current value determines the target suction pressure;

a first detector for detecting an external condition that represents the load on the external drive source;

a second detector for detecting an external condition that represents a required cooling performance of the refrigeration circuit; and a controller for controlling the value of current supplied to the actuator, wherein the controller selects a control mode to be executed from a usual displacement control and a displacement limiting control based on the external condition detected by the first detector, wherein, when the usual displacement control is selected, the controller sets the current value to a target value, which corresponds to the external condition detected by the second detector, wherein, when the displacement limiting control is selected, the controller temporarily sets the current value to a specific value to minimize the compressor displacement, wherein, when the control mode is switched from the displacement limiting control to the usual displacement control, the controller changes the current value from the specific value to the target value taking a predetermined restoration period, and wherein, for at least an initial period of the restoration period, the controller sets the current value to a value that is closer to the target value than a corresponding value on a direct proportional line, which represents a constant rate of change from the specific value to the target value.

13. The control device according to claim 12, wherein, at substantially the same time as the displacement limiting control is finished, the controller instantaneously changes the current value to a first value, the first value being between the specific value and the target value.

14. The control device according to claim 13, wherein the controller maintains the current value to the first value for a predetermine first period after the displacement limiting control is finished, wherein, for a subsequent second period, the controller maintains the current value to a second value, which is closer to the specific value than the first value, and then gradually changes the current value from the second value to the target value along the direct proportional line.

15. The control device according to claim 13, wherein, during the restoration period, the controller gradually changes the current value at a constant rate from the first value to the target value.

16. The control device according to claim 12, wherein the external drive source is a vehicle engine, and the first detector detects a depression degree of an acceleration pedal of the vehicle.

17. The control device according to claim 12, wherein the compressor is installed in a vehicle, wherein the second detector includes a temperature sensor for detecting the temperature of a passenger compartment and a temperature adjuster for setting a target value of the passenger compartment temperature, wherein, when the usual displacement control is selected, the controller determines the current value in accordance with the difference between the detected compartment temperature and the set target temperature.

18. A method for controlling the displacement of a compressor that changes the displacement in accordance with the pressure in a control pressure chamber, comprising:

controlling the pressure in the control pressure chamber by a control valve, wherein the control valve has a valve body and an electromagnetic actuator for actuating the valve body, wherein the actuator urges the valve body by a force the magnitude of which corresponds to the value of current supplied to the actuator;

detecting external conditions that are necessary for controlling the compressor displacement;

selecting a control mode to be executed from a usual displacement control and a displacement limiting control based on the detected external conditions;

setting the current value to a target value, which corresponds to the detected external conditions, when the usual displacement control is selected;

temporarily setting the current value to a specific value to minimize the compressor displacement when the displacement limiting control is selected; and changing the current value from the specific value to the target value taking a predetermined restoration period when the control mode is switched from the displacement limiting control to the usual displacement control, wherein, for at least part of the restoration period, the current value is set to a value that is closer to the target value than a corresponding value on a direct proportional line, which represents a constant rate of change from the specific value to the target value.

19. The method according to claim 18, wherein the step changing the current value from the specific value to the target value includes instantaneously changing the current value to a first value at substantially the same time as the displacement limiting control is finished, wherein the first value is between the specific value and the target value.

20. The method according to claim 19, wherein the step of changing the current value from the specific value to the target value further includes:

maintaining the current value to the first value for a predetermine first period after the displacement limiting control is finished;

maintaining the current value to a second value, which is closer to the specific value than the first value, for a second period, which is subsequent to the first period; and gradually changing the current value from the second value to the target value along the direct proportional line after the second period.

* * * * *

UNITED STATES PATENT AND TRADEMARK OFFICE

CERTIFICATE OF CORRECTION

PATENT NO. : 6,358,016 B1 
DATED : March 19, 2002
INVENTOR(S) : Shigeyuki Hidaka et al.

It is certified that error appears in the above-identified patent and that said Letters Patent is hereby corrected as shown below:

Title page,
Item [57], ABSTRACT,
Lines 10-11, please delete "usual In displacement" and insert therefor -- usual displacement --

Column 2,
Lines 8-9, please delete "abruptly to accelerated" and insert therefor -- abruptly accelerated --;
Line 46, please delete "the it maximum" and insert therefor -- the maximum --;

Column 5,
Lines 39-40, please delete "swash By plate" and insert therefor -- swash plate --;

Column 7,
Lines 48-49, please delete "crank. pressure" insert therefor -- crank pressure --;
Line 49, please delete "body, 44" and insert therefor -- body 44 --;
Line 50, please delete "is than" and insert therefor -- is higher than --;

Column 8,
Line 4, please delete "greatr" and insert therefor -- greater --;

Column 9,
Line 34, please delete "faborably" and insert therefor -- favorably --;
Line 55, please delete "greatr" and insert therefor -- greater --;
Line 66, please delete "the is current" and insert therefor -- the current --;

Column 13,
Line 17, please delete "predetermine" and insert therefor -- predetermined --;

Column 14,
Line 39, please delete "predetermine" and insert therefor -- predetermined --;

UNITED STATES PATENT AND TRADEMARK OFFICE

CERTIFICATE OF CORRECTION

PATENT NO. : 6,358,016 B1 
DATED : March 19, 2002
INVENTOR(S) : Shigeyuki Hidaka et al.

It is certified that error appears in the above-identified patent and that said Letters Patent is hereby corrected as shown below:

Column 16,
Lines 1-2, please delete "step changing" and insert therefor -- step of changing --;
Line 13, please delete "predetermine" and insert therefor -- predetermined --.

Signed and Sealed this

Fourth Day of June, 2002

*Attest:*

*Attesting Officer*

JAMES E. ROGAN
*Director of the United States Patent and Trademark Office*